US010643509B1

(12) United States Patent
Patterson et al.

(10) Patent No.: US 10,643,509 B1
(45) Date of Patent: May 5, 2020

(54) ILLUMINATED DISPLAY PILLAR

(71) Applicant: MOGL LLC, Austin, TX (US)

(72) Inventors: Lee Michael Patterson, Austin, TX (US); Carolyn Louise Querbes, Austin, TX (US)

(73) Assignee: MOGL LLC, Austin, TX (US)

( * ) Notice: Subject to any disclaimer, the term of this patent is extended or adjusted under 35 U.S.C. 154(b) by 0 days.

(21) Appl. No.: 16/367,983

(22) Filed: Mar. 28, 2019

(51) Int. Cl.
*G09F 13/18* (2006.01)

(52) U.S. Cl.
CPC ..... *G09F 13/18* (2013.01); *G09F 2013/1877* (2013.01)

(58) Field of Classification Search
CPC .. G09F 13/18; G09F 2013/1877; G09F 13/04; G09F 2013/0468; G09F 2013/0481
See application file for complete search history.

(56) References Cited

U.S. PATENT DOCUMENTS 597,439 A * 1/1898 Shaw ..... G09F 13/04 40/557
1,066,493 A * 7/1913 Harrold ..... G09F 23/00 40/441
1,114,834 A * 10/1914 Wight ..... G09F 13/06 362/812
1,180,138 A * 4/1916 Giese ..... G09F 13/04 280/1.13

(Continued)

FOREIGN PATENT DOCUMENTS

CA 2447387 5/2005
CN 2660306 12/2004

(Continued)

OTHER PUBLICATIONS

Custom acrylic circular rotating signs letter outdoor advertising led light box, View led light box, Guose Product Details from Foshan Nanhai Guose Identification Co., Ltd. on Alibaba.com. (n.d.). Retrieved from https://fsguose.en.alibaba.com/product/60520793245-802487935/custom_acrylic_circular_rotating_signs_letter_ outdoor_advertising_led_light_box.html?spm=a2700.icbuShop.prewdfa4cf.38.4a19111ef9RYAr; 13 pages, Jul. 1, 2019.

(Continued)

*Primary Examiner* — Gary C Hoge
(74) *Attorney, Agent, or Firm* — Baker Botts L.L.P.

(57) ABSTRACT

An illuminated display pillar, including a post, including a window extending around a portion of a circumference of the cylindrical post and first and second openings positioned at opposite ends of the cylindrical post; a flexible membrane positioned within the cylindrical post and adjacent to the window, the flexible membrane including transparent and opaque portions; a light transmissive cylindrical housing positioned at the first opening, the cylindrical housing including a top portion and a curved portion extending about the circumference of the cylindrical housing; a shade positioned on the curved portion of the cylindrical housing; and a light source positioned at the second opening to provide illumination through the window and the cylindrical housing, wherein the shade separates the illumination through the top portion of the cylindrical housing from the illumination through the curved portion of the cylindrical housing.

18 Claims, 3 Drawing Sheets

(56) References Cited

U.S. PATENT DOCUMENTS

| | | | | |
|---|---|---|---|---|
| 1,663,386 | A * | 3/1928 | Rice | G09F 13/04 40/564 |
| 2,237,536 | A * | 4/1941 | Wells, Jr. | E01F 9/688 116/63 P |
| 3,071,764 | A * | 1/1963 | Frezieres | F21S 9/02 340/321 |
| 3,313,056 | A * | 4/1967 | Williams | G09F 13/04 40/502 |
| 3,713,237 | A | 1/1973 | Thomson et al. | |
| 3,752,192 | A * | 8/1973 | Kleppin | E03B 9/12 137/802 |
| 4,843,525 | A * | 6/1989 | Williams | F21S 9/037 136/291 |
| 5,105,347 | A * | 4/1992 | Ruud | F21S 8/083 362/153.1 |
| 5,116,204 | A | 5/1992 | Power et al. | |
| 5,641,226 | A * | 6/1997 | Jautz, Jr. | G09F 13/04 362/235 |
| 6,050,012 | A * | 4/2000 | Greenfield | G09F 13/04 40/564 |
| 6,345,458 | B1 | 2/2002 | Garibian | |
| 6,427,369 | B1 * | 8/2002 | Durinzi, Jr. | G09F 13/04 362/812 |
| 6,802,143 | B1 * | 10/2004 | Rachowitz | G09F 15/0081 40/473 |
| 7,150,117 | B2 * | 12/2006 | Venegas, Jr. | F21S 8/083 40/580 |
| 7,310,901 | B1 * | 12/2007 | Estes | G09F 13/00 40/564 |
| 7,425,084 | B2 | 9/2008 | Ruud et al. | |
| 9,443,454 | B1 | 9/2016 | Treece | |
| 9,454,921 | B2 | 9/2016 | Williams et al. | |
| 9,607,094 | B2 | 3/2017 | Kawasato | |
| 2004/0114368 | A1 * | 6/2004 | Shyu | F21S 10/00 362/280 |
| 2004/0233220 | A1 | 11/2004 | Decaux et al. | |
| 2004/0246727 | A1 * | 12/2004 | Anderson | G09F 13/04 362/367 |
| 2006/0070281 | A1 | 4/2006 | Passannante | |
| 2009/0178316 | A1 * | 7/2009 | Parenti | G09F 13/04 40/564 |
| 2009/0323315 | A1 * | 12/2009 | Tuite | G09F 13/04 362/98 |
| 2011/0185607 | A1 | 8/2011 | Forster et al. | |
| 2012/0081905 | A1 * | 4/2012 | Santiago | F21V 1/22 362/294 |
| 2012/0310720 | A1 | 12/2012 | Balsan et al. | |
| 2013/0070447 | A1 * | 3/2013 | Darland | F21V 33/00 362/217.14 |
| 2013/0132810 | A1 | 5/2013 | Jandt | |
| 2013/0321259 | A1 | 12/2013 | Insko | |
| 2014/0047747 | A1 | 2/2014 | Jackson | |
| 2014/0279072 | A1 | 9/2014 | Joseph | |
| 2015/0091823 | A1 | 4/2015 | Stone | |

FOREIGN PATENT DOCUMENTS

| | | |
|---|---|---|
| CN | 2800417 | 7/2006 |
| CN | 201022030 | 2/2008 |
| CN | 202469828 | 10/2012 |
| CN | 202475827 | 10/2012 |
| CN | 202855259 | 4/2013 |
| CN | 203160153 | 8/2013 |
| CN | 104501068 | 4/2015 |
| CN | 104534384 | 4/2015 |
| CN | 204313189 | 5/2015 |
| CN | 204313190 | 5/2015 |
| CN | 204632292 | 9/2015 |
| CN | 205016148 | 2/2016 |
| CN | 206034954 | 3/2017 |
| CN | 206058845 | 3/2017 |
| CN | 206112793 | 4/2017 |
| CN | 106782186 | 5/2017 |
| CN | 104809966 | 7/2017 |
| CN | 206610567 | 11/2017 |
| CN | 207833861 | 9/2018 |
| DE | 3832179 | 4/1990 |
| DE | 3914993 | 5/1990 |
| DE | 199216845 | 4/1993 |
| DE | 29500269 | 4/1995 |
| DE | 29500778 | 5/1995 |
| DE | 19631453 | 2/1998 |
| DE | 19706420 | 8/1998 |
| DE | 29823125 | 7/1999 |
| DE | 10045445 | 8/2002 |
| DE | 202005011384 | 11/2005 |
| DE | 202011052174 | 3/2012 |
| EP | 1180761 | 10/2005 |
| EP | 1446788 | 7/2009 |
| ES | 1011014 | 3/1990 |
| GB | 1282578 | 7/1972 |
| GB | 2541372 | 2/2017 |
| JP | 2005341369 | 12/2005 |
| JP | 03120010 | 3/2006 |
| JP | 03997800 | 10/2007 |
| JP | 03144232 | 8/2008 |
| JP | 03211305 | 7/2017 |
| KR | 2008096049 | 10/2008 |
| KR | 2011102129 | 9/2011 |
| KR | 20130055751 | 5/2013 |
| KR | 1350219 | 1/2014 |
| KR | 1369890 | 3/2014 |
| KR | 2017070473 | 6/2017 |
| KR | 2017119987 | 10/2017 |
| WO | 1996008808 | 3/1996 |
| WO | 1999065009 | 12/1999 |
| WO | 2006070122 | 7/2006 |
| WO | 2016159912 | 10/2016 |
| WO | 2017076338 | 5/2017 |

OTHER PUBLICATIONS

Innovative Adveritising Media—Advertising Light Boxes Display—Buy Advertising Boxes,Advertising Stands For Goods,Light Box Panels Product on Alibaba.com. (n.d.). Retrieved Jul. 1, 2019, from https://www.alibaba.com/product-detail/Innovative-advertising-media--advertising-light_512180975.html; 8 pages.

Boureier, Catherine. "NFC and marketing—bridging the gap." (2012); 20 pages.

5 Reasons why QR Codes are still Effective. (n.d.). Retrieved from https://blog.beaconstac.com/2014/01/5-reasons-Why-qr-codes-are-still-effective/, Jan. 5, 2014; 18 pages.

/@GoMeta. (Mar. 6, 2018). Gamify Your Marketing with Interactive AR Experiences—No coding required. Retrieved from https://medium.com/metaverseapp/gamify-your-marketing-with-interactive-ar-experiences-no-coding-required-28dbb34a218e; 22 pages.

NFC Advertisement Marketing Sticker Interesting Counter—Quality Traceability—Customer Purchase Route Analysis. (n.d.). Retrieved from http://www.rfidtagworld.com/products/NFC-Marketing-Poster-Tag_1804.html; 7 pages, Jul. 1, 2019.

M313 Hot sale Hair salon sign Barber shop pole lights for barbershop, View lights for barbershop, May young Product Details from Guangzhou Meiyang Electrical Co., Ltd. on Alibaba.com. (n.d.). Retrieved from http://www.cnmeiyang.cn/product/60673828271-214986297/Hot_sale_Hair_salon_sign_Barbershop_pole_lights_for_barbershop.html; 8 pages, Jul. 1, 2019.

* cited by examiner

ILLUMINATED DISPLAY PILLAR

BACKGROUND

Field of the Disclosure

The disclosure relates generally to display pillars, including illuminated display pillars.

Description of the Related Art

Illuminated display devices for displaying information and, in particular for displaying advertising material, are often effective. One typical form of illuminated displays is a back lit display in which a translucent or transparent display surface is back illuminated by a light and display material in sheet form, such as an advertising poster, that is attached to the inside of the display surface. Such back lit illuminated displays are commonly used for display and advertising purposes.

SUMMARY

Innovative aspects of the subject matter described in this specification may be embodied in an illuminated display pillar, comprising a post, comprising: i) a lower portion and an upper portion, the lower portion and the upper portion substantially opaque; ii) a middle portion positioned between the lower and upper portions, the middle portion including a window extending around at least a portion of a circumference of the cylindrical post; iii) a first opening positioned at a first end of the post and a second opening positioned at a second, opposing end of the cylindrical post; a flexible membrane positioned within the post and adjacent to the window, the flexible membrane including transparent and opaque portions; a light transmissive cylindrical housing positioned at the first opening, the cylindrical housing including a top portion and a curved portion extending about the circumference of the cylindrical housing; a shade positioned on the curved portion of the cylindrical housing; and a light source positioned near the second opening to provide illumination through the window and the cylindrical housing, wherein the shade separates the illumination through the top portion of the cylindrical housing from the illumination through the curved portion of the cylindrical housing. The post is cylindrical. The cylindrical post includes an inner diameter and an outer diameter, with the light source being positioned within the inner diameter These and other embodiments may each optionally include one or more of the following features. For instance, the shade includes an opening, the opening of the shade overlaying the top portion of the cylindrical housing. The opening of the shade is flush with the top portion of the cylindrical housing. The shade includes a flange, the flange extending past the circumference of the cylindrical post. The flexible membrane exerts a force against an inner diameter of the cylindrical post to maintain a positioning of the membrane with respect to the window. A portion of the middle portion is substantially opaque. Further including a stake coupled to the cylindrical post adjacent to the second opening of the cylindrical post. Further including a photovoltaic cell coupled to the light source to provide the illumination. The photovoltaic cell is coupled to the lower portion of the cylindrical post. The flexible membrane includes a quick response (QR) code.

Innovative aspects of the subject matter described in this specification may be embodied in an illuminated display pillar, comprising: a cylindrical post, comprising: i) a lower portion and an upper portion, the lower portion and the upper portion substantially opaque; ii) a middle portion positioned between the lower and upper portions, the middle portion including a window extending around a portion of a circumference of the cylindrical post; iii) a first opening positioned at a first end of the post and a second opening positioned at a second, opposing end of the cylindrical post; a flexible membrane positioned within the cylindrical post and adjacent to the window, the flexible membrane including transparent and opaque portions; a light transmissive cylindrical housing positioned at the first opening, the cylindrical housing including a top portion and a curved portion extending about the circumference of the cylindrical housing; a shade positioned on the curved portion of the cylindrical housing; and a light source positioned at the second opening to provide illumination through the window and the curved portion of the cylindrical housing.

These and other embodiments may each optionally include one or more of the following features. For instance, the shade includes a flange, the flange extending past the circumference of the cylindrical post. The flexible membrane exerts a force against an inner diameter of the cylindrical post to maintain a positioning of the membrane with respect to the window. A portion of the middle portion is substantially opaque. Further including a stake coupled to the cylindrical post adjacent to the second opening of the cylindrical post. Further including a photovoltaic cell coupled to the light source to provide the illumination. The photovoltaic cell is coupled to the lower portion of the cylindrical post. The flexible membrane includes a quick response (QR) code.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF PARTICULAR EMBODIMENT(S)

This specification describes an illuminated display pillar. The display pillar can include an opaque cylindrical post that includes a window extending around a portion of a circumference of the cylindrical post. A flexible membrane can be positioned adjacent to the window and include transparent and opaque portions. A light transmissive cylindrical housing can be positioned atop the cylindrical post. A shade can be positioned atop the cylindrical housing. A light source positioned at the opposite end of the cylindrical post can provide illumination through the window and the cylindrical housing. The shade can separate the illumination through a top portion of the cylindrical housing from illumination through a curved portion of the cylindrical housing.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Figure 1:
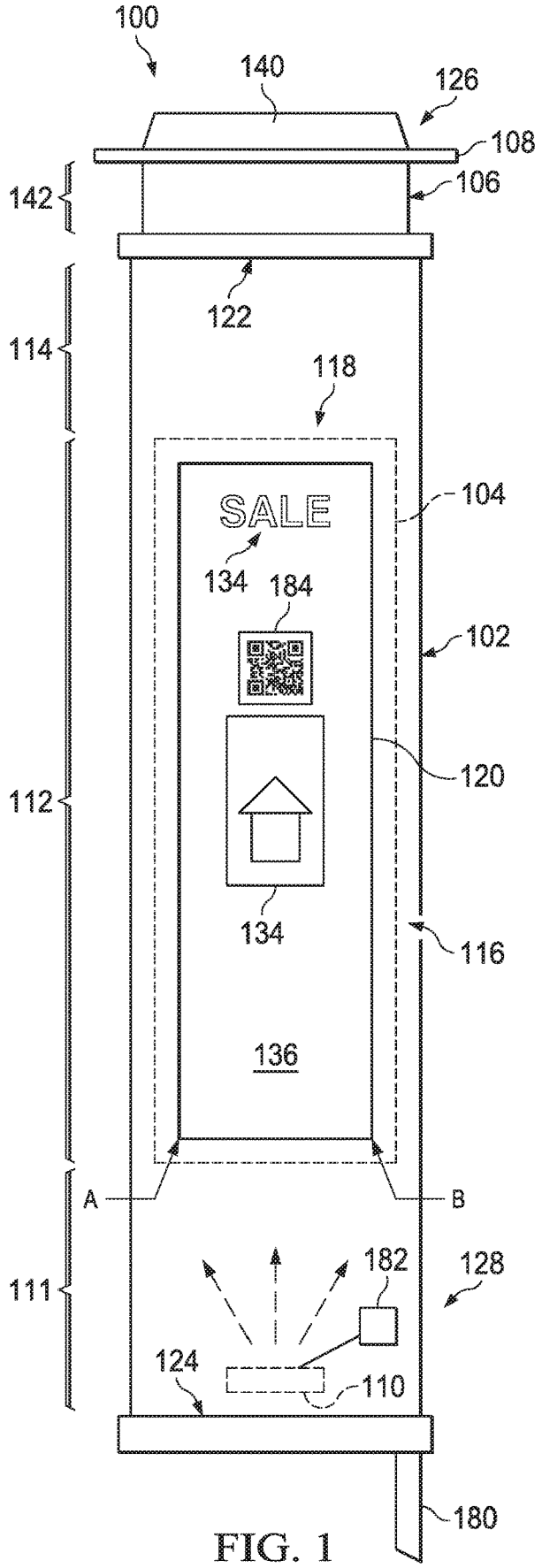
FIG. 1 illustrates a side view of an illuminated display pillar.

FIG. 1 illustrates an illuminated display pillar 100. The display pillar 100 can include a cylindrical post 102, a flexible membrane 104, a light transmissive cylindrical housing 106, a shade 108, and a light source 110. The cylindrical post 102 can include a lower portion 111, a middle portion 112, and an upper portion 114. In some examples, the post 102 can include other geometric shapes (cross-sectional views) such as a square-based shape, a rectangular-based shape, or any geometric shape desired. The lower portion 111 and the upper portion 114 can be substantially opaque. The middle portion 112, positioned between the lower portion 111 and the upper portion 114, can include a first sub-portion 116 and a second sub-portion 118.

The first sub-portion 116 of the middle portion 112 can be substantially opaque. The second sub-portion 118 of the middle portion 112 can include a window 120 that extends around a circumference of the cylindrical post 102. The window 120 can extend around the circumference of the cylindrical post 102 any desired amount—in the illustrated example, the window 120 extends between points A and B (approximately one-half of the circumference of the cylindrical post 102). However, in some examples, the window 120 can extend around the circumference of the cylindrical post 102 greater than the circumferential distance between points A and B, or less than the circumferential distance between points A and B.

Figure 2:
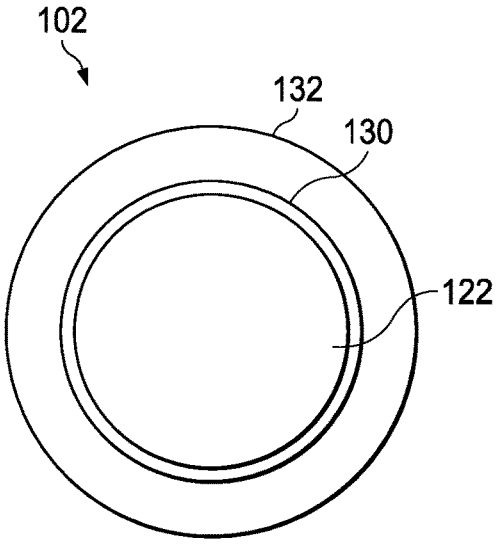
FIG. 2 illustrates a top-down view of the illuminated display pillar.

The cylindrical post 102 further includes a first opening 122 and a second opening 124. The first opening 122 can be positioned at a first end 126 of the cylindrical post 102 and the second opening 124 can be positioned at a second end 128 of the cylindrical post 102. The first end 126 and the second end 128 can be at opposite ends of the cylindrical post 102. In some embodiments, the cylindrical post 102 is hollow—that is, the cylindrical post 102 includes an inner diameter 130 and an outer diameter 132, as shown in FIG. 2.

The flexible membrane 104 can be positioned within the cylindrical post 102 and adjacent to the window 120. That is, the flexible membrane 104 can be positioned to be in contact with the inner diameter 130 of the cylindrical post 102. The flexible membrane 104 can include transparent portions 134 and opaque portions 136. In some examples, the flexible membrane 104 can further include translucent portions (not shown). In some examples, the flexible membrane 104 comprises a material (e.g., semi-rigid material or rigid material) such that the flexible membrane 104 exerts a force against the inner diameter 130 of the cylindrical post 102 to maintain a desired positioning of the flexible membrane 104 with respect to the window 120. Specifically, the flexible membrane 104 exerts a force against the cylindrical post 102 at portions adjacent to the window 120 and about the inner diameter 130. In some examples, the flexible membrane 104 can be positioned within the cylindrical post 102 and adjacent to the window 120 by other means such brackets, screws, and other coupling methods.

The light transmissive cylindrical housing 106 can be positioned at the first opening 122 of the cylindrical post 102. That is, the cylindrical housing 106 can be coupled to the cylindrical post 102 at the first opening 122. The cylindrical housing 106 can be fixedly attached to the cylindrical post 102 such as by fasteners, or adhesive. In some examples, the cylindrical housing 106 can be removably attached to the cylindrical post 102.

The cylindrical housing 106 can include a top portion 140 and a curved portion 142 that extends about the circumference of the cylindrical housing 106. Each of the top portion 140 and the curved portion 142 can be substantially light transmissive, or a portion of the top portion 140 and the curved portion 142 are light transmissive. A circumference of the cylindrical housing 106 can be substantially the same as the circumference of the cylindrical post 102. However, in some examples, the circumference of the cylindrical housing 106 can be larger or smaller than the circumference of the cylindrical post 102. In some examples, the circumference of the cylindrical housing 106 can be substantially the same as the inner diameter 130 of the cylindrical post 102.

Figure 3:
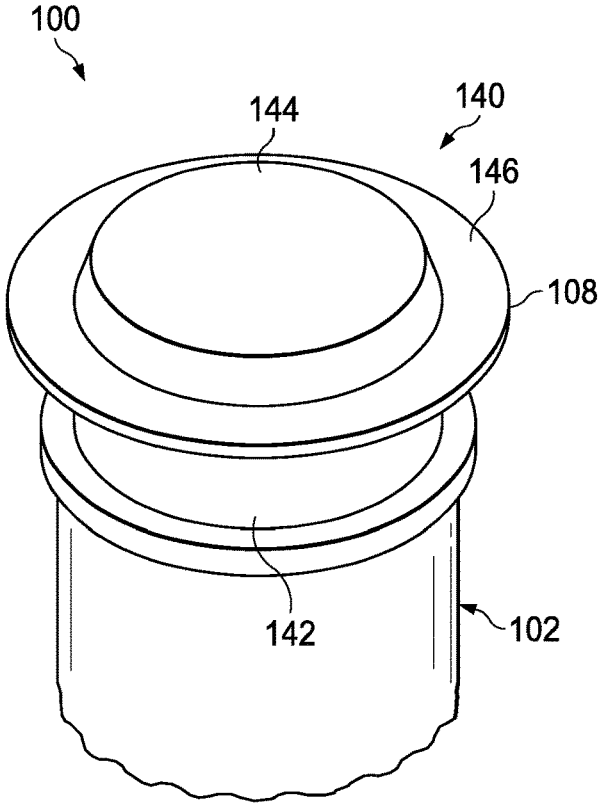
FIG. 3 illustrates a perspective view of the illuminated display pillar.

Referring to FIGS. 1 and 3, the shade 108 can be positioned on the curved portion 142 of the cylindrical housing 106. The shade 108 can include an opening 144 and a flange 146. The opening 144 can overlay the top portion 140 of the cylindrical housing 106, and can be flush with the top portion 140 of the cylindrical housing 106. The shade 108 can include a circumference that is substantially the same as the circumference of the cylindrical post 102. In some examples, the flange 146 can further extend past the circumference of the cylindrical post 102.

The light source 110 is positioned at the second opening 124 of the cylindrical post 102. The light source 110 can be fixedly attached to the cylindrical post 102—e.g., by screws, fasteners, or other means. In some examples, the light source 110 is removably attached to the cylindrical post 102. The light source 110 can include a mechanism that provides illumination, including LED or solar-based lights. To that end, the light source 110 provides illumination through the window 120 and the cylindrical housing 106. That is, the light source 110 directs illumination from the second opening 124 towards the first opening 122, and further, through the window 120 and the cylindrical housing 106.

The shade 108 can separate the illumination that is provided through the cylindrical housing 106. That is, the shade 108 can separate the illumination through the top portion 140 of the cylindrical housing 106 from the illumination through the curved portion 142 of the cylindrical housing 106. Separation of the illumination through the top portion 140 of the cylindrical housing 106 from the illumination through the curved portion 142 of the cylindrical housing 106 can facilitate having a distinct and a separate visual appearance of the illumination though the cylindrical housing 106. That is, two separate illuminations are provided through the cylindrical housing 106—through the top portion 140 and the curved portion 142—from the light source 110.

In some examples, the shade 108 includes a cover (not shown) that is in superimposition with the top portion 140 of the cylindrical housing 106. The cover can include a photovoltaic cell that is coupled to the light source 110 to provide the illumination through the illuminated display pillar 100. The light source 110 provides illumination through the window 120 and the cylindrical housing 106. That is, the light source 110 directs illumination from the second opening 124 towards the first opening 122, and further, through the window 120 and the curved portion 142 of the cylindrical housing 106. In some examples, the cover is removable.

In some examples, the display pillar 100 includes a light transmissive spherical housing (not shown) in lieu of the cylindrical housing 106. The spherical housing can be coupled to the cylindrical post 102 at the first opening 122. The spherical housing can be fixedly attached to the cylindrical post 102 such as by fasteners, or adhesive. The spherical housing can be removably attached to the cylindrical post 102. A circumference of the spherical housing can be substantially the same as the circumference of the cylindrical post 102. However, in some examples, the circumference of the spherical housing can be larger or smaller than the circumference of the cylindrical post 102. To that end, the light source 110 provides illumination through the window 120 and the spherical housing. That is, the light source 110 directs illumination from the second opening 124 towards the first opening 122, and further, through the window 120 and the spherical housing.

The illuminated display pillar 100 can further include a stake 180 that is coupled to cylindrical post 102 adjacent to the second opening 124 of the cylindrical post 102. The stake 180 can have a shape such that the same can be positioned within a substrate—e.g., a natural ground—by positioning the stake within the substrate. Thus, the illuminated display pillar 100 can be positioned within the same substrate. The stake 180 can further include, or be coupled to, a locking mechanism such that the stake 180, and the illuminated display pillar 100, cannot be removed from the substrate once inserted without a proper unlocking mechanism.

The illuminated display pillar 100 can further comprise a photovoltaic cell (solar cell) 182 that is coupled to the light source 110 to provide the illumination. That is, the light source 110 can be in electrical communication with the photovoltaic cell 182 to obtain energy (power) from the photovoltaic cell 182 to provide the illumination by the light source 110. In some examples, the light source 110 can further be connected to electrical power via an electrical grid—in place of, or in coordination with—receiving electrical power from the photovoltaic cell 182. In some examples, the photovoltaic cell 182 is coupled to the lower portion 111 of the cylindrical post 102.

In some examples, the flexible membrane 104 includes an advertisement or other informational, promotional, or similar content. In a use-case example, the illuminated display pillar 100 can be positioned adjacent a physical property associated with a real estate listing. The illuminated display pillar 100, and in particular, the flexible membrane 104, can display information associated with the real estate listing. For example, the flexible membrane 104 can list information regarding particulars of the physical property, and contact information associated with the real estate listing. In a further use-case example, the illuminated display pillar 100 can be positioned adjacent an event space that is hosting an event. The illuminated display pillar 100, and in particular, the flexible membrane 104, can display information associated with the event, such as a time of the event and speakers at the event.

In some examples, the flexible membrane 104 includes a quick response (QR) code 184. The QR code 184 can be scanned and processed by a computing system—e.g., a mobile computing device or tablet computing device—to provide detail regarding information associated with the illuminated display pillar 100 and/or the flexible membrane 104 that is presented for display by the computing system.

In some examples, the illuminated display pillar 100 can further include an augmented reality (AR) and/or virtual reality (VR) system (not shown). The AR/VR system can be positioned within the cylindrical post 102 and provide for display AR and/or VR images—e.g., images associated with information contained by the flexible membrane 104 and/or the display pillar 100. In some examples, the illuminated display pillar 100 includes a holographic system ( ). The holographic system can be positioned within the cylindrical post 102 and provide holographic images—e.g., images associated with information contained by the flexible membrane and/or the display pillar 100.

Figure 4:
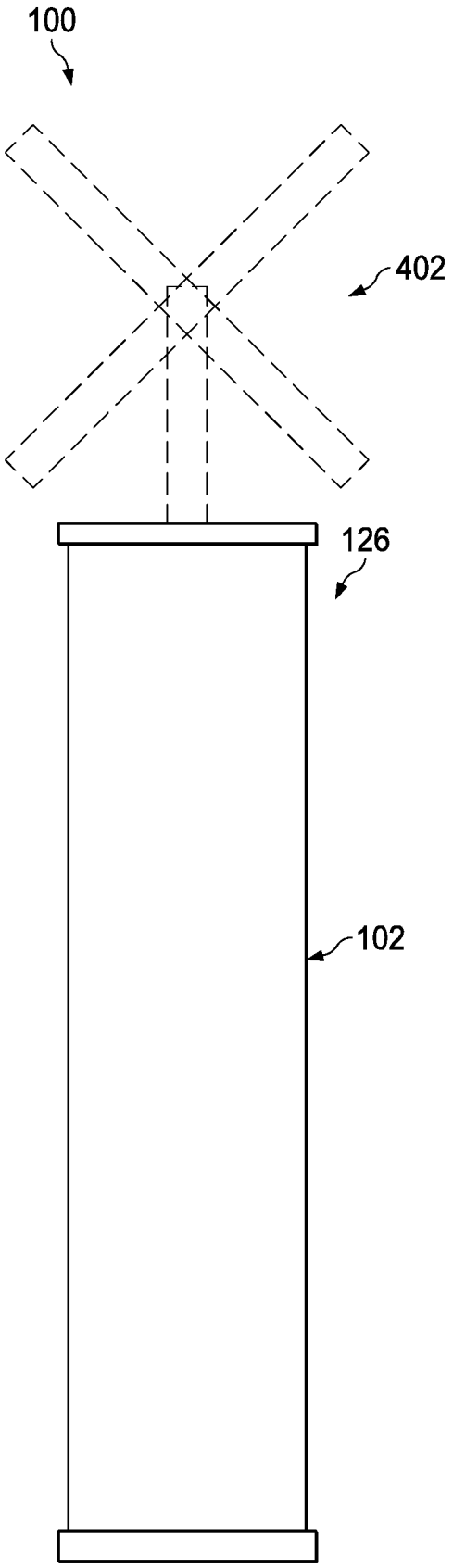
FIG. 4 illustrates a side view of the illuminated display pillar, including a holographic fan.

Referring to FIG. 4, in some examples, the holographic system can include a holographic fan 402 positioned at the first end 126 of the cylindrical post 102. The holographic fan 402 can be coupled to a tripod (not shown) positioned within the display pillar 100, and including one or more legs to support the holographic fan 402. In some examples, the holographic fan 402 can be utilized in lieu of the light transmissive cylindrical housing 106, or in combination with the light transmissive cylindrical housing 106.

In some examples, the illuminated display pillar 100 can further proximity detection systems such as Bluetooth, Geofencing and/or near field communications (NFC). The proximity detection systems can detect when a computing system—e.g., a mobile computing device or tablet computing device—is proximate to the display pillar 100. This proximity detection can facilitate identification of the display pillar 100 by the computing system—e.g., in coordination with the computing system scanning the QR code of the display pillar 100.

In some examples, the illuminated display pillar 100 can further include an audio system (not shown). The audio system can provide audio that is associated with the information that is contained by the flexible membrane 104 and/or the display pillar 100.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated other-wise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. An illuminated display pillar, comprising:

a post, comprising:

i) a lower portion and an upper portion, the lower portion and the upper portion substantially opaque;

ii) a middle portion positioned between the lower and upper portions, the middle portion including a window extending around at least a portion of a circumference of the post;

iii) a first opening positioned at a first end of the post and a second opening positioned at a second, opposing end of the post;

a flexible membrane positioned within the post and adjacent to the window, the flexible membrane including transparent and opaque portions, the flexible membrane including a quick response (QR) code;

a light transmissive cylindrical housing positioned at the first opening, the cylindrical housing including a top portion and a curved portion extending about the circumference of the cylindrical housing;

a shade positioned on the curved portion of the cylindrical housing; and a light source positioned near the second opening to provide illumination through the window and the cylindrical housing, wherein the shade separates the illumination through the top portion of the cylindrical housing from the illumination through the curved portion of the cylindrical housing.

2. The illuminated display pillar of claim 1, wherein the shade includes an opening, the opening of the shade overlaying the top portion of the cylindrical housing.

3. The illuminated display pillar of claim 2, wherein the opening of the shade is flush with the top portion of the cylindrical housing.

4. The illuminated display pillar of claim 1, wherein the shade includes a flange, the flange extending past the circumference of the post.

5. The illuminated display pillar of claim 1, wherein the flexible membrane exerts a force against an inner diameter of the post to maintain a positioning of the membrane with respect to the window.

6. The illuminated display pillar of claim 1, wherein a portion of the middle portion is substantially opaque.

7. The illuminated display pillar of claim 1, further comprising a stake coupled to the post adjacent to the second opening of the post.

8. The illuminated display pillar of claim 1, further comprising a photovoltaic cell coupled to the light source to provide the illumination.

9. The illuminated display pillar of claim 8, wherein the photovoltaic cell is coupled to the lower portion of the post.

10. The illuminated display pillar of claim 1, wherein the post is cylindrical.

11. The illuminated display pillar of claim 10, wherein the cylindrical post includes an inner diameter and an outer diameter, with the light source being positioned within the inner diameter.

12. An illuminated display pillar, comprising:

a cylindrical post, comprising:

i) a lower portion and an upper portion, the lower portion and the upper portion substantially opaque;

ii) a middle portion positioned between the lower and upper portions, the middle portion including a window extending around a portion of a circumference of the cylindrical post;

iii) a first opening positioned at a first end of the cylindrical post and a second opening positioned at a second, opposing end of the cylindrical post;

a flexible membrane positioned within the cylindrical post and adjacent to the window, the flexible membrane including transparent and opaque portions, wherein the flexible membrane includes a quick response (QR) code;

a light transmissive cylindrical housing positioned at the first opening, the cylindrical housing including a top portion and a curved portion extending about the circumference of the cylindrical housing;

a shade positioned on the curved portion of the cylindrical housing; and a light source positioned at the second opening to provide illumination through the window and the curved portion of the cylindrical housing.

13. The illuminated display pillar of claim 12, wherein the shade includes a flange, the flange extending past the circumference of the cylindrical post.

14. The illuminated display pillar of claim 12, wherein the flexible membrane exerts a force against an inner diameter of the cylindrical post to maintain a positioning of the membrane with respect to the window.

15. The illuminated display pillar of claim 12, wherein a portion of the middle portion is substantially opaque.

16. The illuminated display pillar of claim 12, further comprising a stake coupled to the cylindrical post adjacent to the second opening of the cylindrical post.

17. The illuminated display pillar of claim 12, further comprising a photovoltaic cell coupled to the light source to provide the illumination.

18. The illuminated display pillar of claim 17, wherein the photovoltaic cell is coupled to the lower portion of the cylindrical post.

* * * * *